United States Patent [19]

Palacino et al.

[11] 4,303,030

[45] Dec. 1, 1981

[54] DEVICE FOR CONTROLLING STITCH CHAINS IN SEWING MACHINES HAVING A PLURALITY OF NEEDLES

[76] Inventors: Giovanni Palacino, Via dei Giacinti 12; Angelo Radice, Largo Promessi Sposi 7, both of Milan, Italy

[21] Appl. No.: 172,054

[22] Filed: Jul. 25, 1980

[30] Foreign Application Priority Data

Sep. 20, 1979 [IT] Italy ..... 25840 A/79

[51] Int. Cl.[3] ..... D05B 65/02; D05B 53/00

[52] U.S. Cl. ..... 112/286; 112/288; 112/302; 112/260

[58] Field of Search ..... 112/253, 286, 302, 130, 112/288, 260

[56] References Cited

U.S. PATENT DOCUMENTS

| | | | |
|---|---|---|---|
| 3,640,236 | 2/1972 | Nicolay | 112/286 X |
| 4,038,933 | 8/1977 | Marjorio | 112/253 X |
| 4,072,116 | 2/1978 | Nagy | 112/286 |

FOREIGN PATENT DOCUMENTS

| | | | |
|---|---|---|---|
| 2814965 | 11/1978 | Fed. Rep. of Germany | 112/253 |
| 2905226 | 8/1979 | Fed. Rep. of Germany | 112/286 |

*Primary Examiner*—H. Hampton Hunter

[57] ABSTRACT

A device for sewing machines having more than one stitch forming needle for grouping together and aligning the threads of stitch chains with the sewing axis which were formed on individual tongues of the machine's needle plate. An integral projection formed on the needle plate in spaced relation to the tongues is provided on each side thereof with camming surfaces one of which is effective in grouping all of the threads together withdrawn from their respective tongues and the other guides the grouped threads to a position for entry into one of the plate's needle throats after which they become aligned with the sewing axis and then cut to a desired length and the cut portion restrained for incorporation into the next seam to be formed.

5 Claims, 3 Drawing Figures

DEVICE FOR CONTROLLING STITCH CHAINS IN SEWING MACHINES HAVING A PLURALITY OF NEEDLES

BACKGROUND OF THE INVENTION

The present invention pertains to a device for cutting and restraining a chain of stitches in sewing machines having two or more needles so as to effect incorporation of this chain into the following seam of stitches. To incorporate the length of a chain of stitches formed after completion of a preceding seam into the following seam, it is necessary that the entire length which was formed be manipulated so that it is aligned with the sewing axis.

Prior to the instant invention chains formed by a single series of stitches, i.e., each chain is formed by a single needle, have been aligned with the sewing axis by manipulating them individually or combining separate chains as is done when forming so-called safety seams.

With reference to forming safety seams, the known types of cutting and retaining devices utilized have a needle plate with a needle hole arranged to effect a series of straight stitches and a throat portion with an associated tongue with which a needle cooperates to form a series of whipped or overlocked stitches. This needle plate also includes a transverse slot which interconnects the needle hole with the throat in an area disposed forwardly of the needle and serves as a means whereby the chain of straight stitchs can be moved from the needle hole to the throat to be with the chain of whipped stitches at the appropriate time when they should be cut and held in alignment with the sewing axis in readiness for the next seaming cycle.

This transverse slot is located forwardly of the needles in order to facilitate complete removal of the chain from the tongue and the necessary relocating of each of the chains with respect to their stitching instrumentalities. Prior to the instant invention there was no desirable means for manipulating the chains of whipped or overlocking stitches which are formed utilizing a plurality of needles such, for example, of those formed by stitches of type 514 according to the American Federal Standard Catalog, wherein the stitches produced by each needle are linked together by a transverse or covering thread. The needle plate provided in sewing machines utilized for the formation of the above type of stitches has, as is well known, at least two throats for the needles disposed in side by side relation and include an equal number of cooperating tongues. These throats are open and communicate with each other in the area where the stitches leave their respective tongues which is located downstream of the stitching instrumentalities. For this reason, it has not been possible upon completion of a seam to utilize known devices, for incorporating a length of chain remaining free on the sewing machine into the next seam.

An object of the present invention is that of providing an improved needle plate having means which facilitates the grouping together of the threads forming the chain that is to be incorporated in the next seam, and to group said threads within the right hand needle throat after having removed them from their respective tongues.

The needle plate according to the invention is characterized by a deflecting means for the threads forming the chains and forms an integral part thereof located downstream of the throats for the needles. This deflecting means is spaced from the needle throats and oriented so as to extend transversly relative to the longitudinal lengths of the latter and is effective in grouping all the threads together prior to their entering the throat for the right hand needle. This operation is accomplished by a single working procedure which may be manual or automatic for removing the thread from their respective tongues and then shifting them together to a position whereat they are cut and held by known devices in alignment with the sewing axis.

The main advantage provided by the present invention is that of providing a means whereby the threads forming chains which are interconnected with the needle or needles to the left of the right hand needle can be readily grouped together and aligned forwardly of the stitching instrumentalities and then be incorporated in the seam which follows in the desired manner. This operating step can be accomplished manually without any complicated or involved procedures on the part of the operator for all that is required is to lightly pull the workpiece in the direction of its normal advance and then turn or rotate it about the needle.

During the manual step of pulling the workpiece, the deflecting means is effective in engaging the threads and grouping them together in the area downsteam of the right hand needle throat and when the workpiece is rotated, it causes all of said threads to enter the right hand needle throat.

A further characteristic of the invention is that the deflecting means defines a transverse projection forming a part of the needle plate and extends across the area adjacent to each needle throat and terminates substantially in line with the tongue of the right hand needle throat. This transverse projection has both its side surfaces tapered towards its point and is spaced from the tongues so as to form an abutment for engaging the threads removed from said tongues in order to deflect them to a position where they will be grouped together prior to entering the throat for the right hand needle.

Other objects and advantages of the present invention will become more fully apparent by reference to the appended claims and as the following detailed description proceeds in reference to the figures of drawing wherein:

DESCRIPTION OF THE PREFERRED EMBODIMENT

Figure 1:
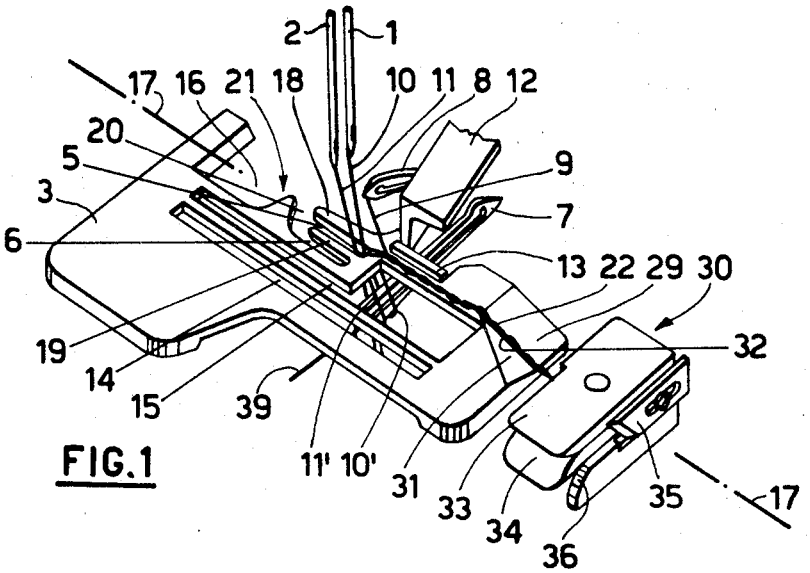
FIG. 1 is a perspective view of a portion of a sewing machine showing the device according to the invention applied thereto.

Referring to the drawing wherein only as much of a conventional sewing machine structure is depicted as is necessary to a complete understanding of the invention, there is shown in FIG. 1 the stitching instrumentalities of the machine which include at least two needles 1 and 2, a needle plate 3 having throats 5 and 6 into which said needles extend to cooperate in a known manner with a lower looper 7. An upper looper is identified by numeral 8 and as is well known, such a looper permits the formation of a seam known as "seam having overlocked stitch with covering stitch" and is distinguished by number 514 in the American Federal Standard Catalog.

In this type of seam, a thread 9 of the upper looper 8 is normally engaged with both a thread 10 of the right hand needle 1 and thread 11 of the left hand needle 2 so as to form the covering stitch for the edge of the workpiece.

The sewing machine which is adapted to produce the stitch referred to above is also provided with a trimming knife 12 which cooperates with a fixed counterblade 13 carried by the needle plate 3 and serves to trim that edge of the workpiece to be sewn.

The needle plate 3 also includes conventional openings 14, 15 and 16 through which the teeth of the feed dogs periodically project to cooperate with the machine's presser foot causing the workpiece during the seaming operation to advance along the sewing axis shown at 17.

Figure 2:
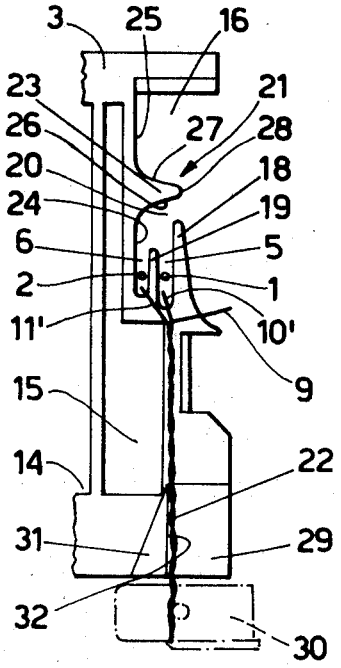
FIG. 2 is a top view of the device shown in FIG. 1.

Referring now to FIG. 2 the needle throat 5 is located below the right hand needle 1 and has a tongue 18 adjacent thereto on which the overlocked stitches are formed in a known manner. The needle throat 6 is located below the left hand needle 2 and is separated from the right hand needle throat 5 by a supplementary, or intermediate, tongue 19 which serves to maintain tension on that portion of thread 9 which joins the two threads for the straight stitches formed by the threads 10 and 11 of the needle 1 and 2 respectively.

Downstream of the stitching instrumentalities which is in the direction of advance of the workpiece, the needle throats 5 and 6 terminate and their entrances are located adjacent to each other in order to permit the removal of the chains of stitches therefrom and to provide an outlet path for them during the operation of the sewing machine.

The deflecting means according to the invention is identified generally by numeral 21 and forming an integral part of the needle plate 3 it is located in that area of said needle plate depicted by numeral 20. This deflecting means is located in spaced relation to the tongues 18 and 19 and is oriented so as to extend transversely to the direction of workpiece travel. The deflecting means 21 provides a means for grouping the threads forming the chains of stitches together and for locating this grouping in a position whereby in a subsequent part of the sequence they will be caused to enter the throat 5 for the right hand needle in a manner which will be more fully described hereinafter.

The deflecting means defines a projection 23 projecting from the external sidewall 24 of the left hand needle throat 6 and from the corresponding wall 25 of the opening 16. In addition to providing an abutment for the chains of threads, the upper horizontal surface of the projection 23 serves as a well known and necessary crosspiece for the needle plate which separates the needle throats from the opening 16 from which one of the rows of teeth of the feed dog are caused to periodically project.

The crosspiece cooperates with the machine's presser foot for restraining the chains of stitches at the time when the teeth of the feed dog are below the needle plate and when the workpiece is no longer interposed between the latter and said presser foot causing the stitches to leave their respective tongues.

The sides of the projection 23 are identified by numerals 26 and 27 and are tapered as shown in FIG. 2 toward said projection's tip or end 28 and define camming surfaces for the threads. This end 28 is disposed so as to be substantially in line with the tongue 18 of the right hand needle throat 5 and both of the tapered sides or camming surfaces 26 and 27 are tangentially connected to walls 24 and 25 respectively.

The tapered side 26 which faces the tongues 18 and 19 is effective because of its inclination relative to the axis of sewing of grouping or camming all of the threads together, particularly those which are connected to the needles 2 and 1 respectively. The gathered threads are caused to move to the rear portion of the transverse projection because they are drawn manually or automatically in the same direction of workpiece advance when operation of the machine has ceased.

After the gathered threads forming the chain 22 have been caused to move to the opposite side 27 of the projection 23, they are not able to re-enter their respective needle throat for limited rotational movement of the workpiece by the operator causes them to be cammed toward the forward portion of the machine and to pass over the end 28 and are aligned so that continued movement causes them to enter the right hand needle throat 5.

Referring again to FIG. 1, the needle plate 3 is provided forwardly of the stitching instrumentalities with an inclined planar surface 29 which extends parallel to the axis of sewing and is directed toward known means generally indicated by numeral 30 for cutting and holding the chain of stitches 22. These cutting and holding means are fixedly positioned relative to the needle plate. The inclined planar surface provides a means for facilitating insertion of the chain of stitches into the cutting and holding apparatus and the latter, as shown in FIG. 1, is positioned so as not to interfere with the advance of a workpiece during the seaming operation.

A tapered surface in the form of a slipway 31 interconnects the upper surface of the needle plate 3 with the inclined planar surfaces 29 and the line of contact between the latter and said slipway defines a guide 32 for maintaining the chain of stitches 22 in the proper position for incorporation into the next seam to be formed.

The apparatus for cutting and holding the chain of stitches is formed by an upper plate member 33 which is biased in the direction of a fixed lower plate member 34 and the chain of stitches 22 at the end of each sewing operation is inserted between said upper and lower plates.

Forwardly of the plates 33 and 34, a chain-cutting knife 35 is provided and its cutting edge is selectively positionable so that it can be positioned in alignment with the guide 32 to cut the chain of stitches, inserted between the plates 33 and 34 to the desired length. A guide arm 36 is assembled in operative association with the knife 35 and serves as a means for guiding the chain to be cut to said knife 35.

To summarize the operation, at the completion of each seaming operation the workpiece is pulled a short distance in the direction in which it was being displaced during the sewing operation, so as to effect removal of all the stitches formed on the tongues 18 and 19.

The first procedure can be performed either manually by the operator or automatically by well known means adapted for this purpose and causes the threads 10 and 11 of the needles and the thread 9 of the upper looper 8 to engage and slide along the tapered side 26 which causes them to become grouped together beyond the end 28 of the projection 23. Movement beyond the end 28 causes these grouped threads to pass below the projection 23 and to assume a position whereby they are in engagement with the tapered side 27 of said projection.

When the threads are grouped together and in engagement with the tapered side 27, the second procedure is that of subjecting the workpiece and the chain of stitches connected therewith to limited rotative movement which is effective in causing said chain to slide along said tapered side 27, past the end 28 and forwardly of the stitching instrumentalities. With the end 28 being in alignment with the tongue 18, the chain of threads after passing said end are caused to enter the right hand needle throat 5. As a result of this manipulation of the various threads, the thread 9 of the upper looper 8 is no longer restrained by the tongues but is engaged with the threads 10' and 11' which extend from the right hand needle throat 5 and which in turn are engaged in the form of a loop with the lower looper 7.

Consequently the thread 9 becomes stretched out above the needle plate 3 in a state where it will not form a stitch in the absence of fabric. When the rotational procedure has been completed, the workpiece is brought to the forward end of the sewing machine and the chain is caused to slide over the slip-way 31 until it reaches the guide 32 formed intermediate said slip-way and the inclined planar surface 29.

The chain of stitches 22 is then inserted between the plates 33 and 34 which serve to restrain or hold it and it is then cut by the knife 35 to free the sewn workpiece.

Figure 3:
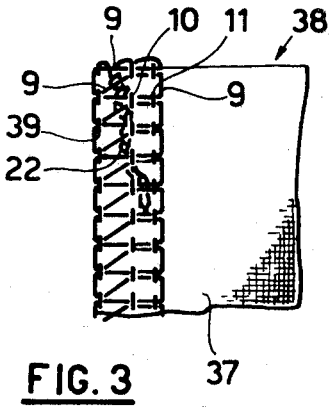
FIG. 3 is a diagrammatical view of a sewn workpiece showing a chain of stitches incorporated into the seam.

At the start of the next sewing operation, the workpiece is placed in contact with the needles 1 and 2 in the customary manner and, as shown in FIG. 3, the seaming commences only when the fabric is engaged by the needles. When seaming starts, the chain of stitches 22 is held against the lower face 37 of the fabric forming the workpiece 38 by the thread 39 of the lower looper 7 which is orientated transversely with respect to the seam being formed and perpendicular to the edge being sewn because it is linked with the thread of the upper looper 8 which is disposed on the other face of the fabric (not shown) and is maintained there by the straight stitches formed by the threads 10 and 11 of the needles.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

I claim:

1. A device for cutting and restraining a chain of stitches for incorporation into the next seam to be formed in sewing machines of the type utilizing a plurality of needles, said device comprising:

(a) a needle plate (3) mounted on the machine in operative association with the needles including:
  (i) a throat element for and in alignment with each needle;
  (ii) tongues (18, 19) forming one side of each said throat elements (5, 6) respectively on which stitches are formed by the needles;
  (iii) deflecting means (21) spaced from said tongues for engaging and grouping together the chains removed from said tongues upon completion of the sewing cycle;
  (iv) camming means (27) forming one side of said deflecting means for guiding the grouped threads to a position for entry into one of said throat elements upon manipulation of the sewn workpiece for its removal from the machine;
  (v) means formed at one end of said needle plate for aligning the chain of stitches extending from the one said throat element with the sewing axis; and (b) means operatively associated with said aligning means for severing the sewn workpiece from the chain; and (c) means attached to said severing means for restraining the severed chain for incorporation into the next seam.

2. The structure according to claim 1 wherein said deflecting means (21) defines a projection (23) having an end (28) disposed in spaced and aligned relation with said tongue (18) and horizontally disposed sides defining camming surfaces (26, 27).

3. The structure according to claim 1 wherein said aligning means defines a guide (32) formed by the junction of an inclined planar surface (29) and a tapered surface defining a slip-way (31) communicating with said inclined planar surface and the upper horizontal surface of said needle plate.

4. The structure according to claim 1 wherein said severing means includes a knife (35) and a guide arm (36) for guiding the chain to be cut to said knife.

5. The structure according to claim 4 wherein said restraining means includes upper and lower plate members (33, 34) with said upper plate member being biased into contact with the lower for holding the severed chain of stitches therebetween in parallel alignment with the sewing axis.

* * * * *